US008220896B2

(12) United States Patent
Nystrom et al.

(10) Patent No.: US 8,220,896 B2
(45) Date of Patent: Jul. 17, 2012

(54) PRINTHEAD DE-PRIME SYSTEM AND METHOD FOR SOLID INK SYSTEMS

(75) Inventors: Peter J. Nystrom, Webster, NY (US); Andrew W. Hays, Fairport, NY (US); Scott J. Phillips, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 497 days.

(21) Appl. No.: 12/405,404

(22) Filed: Mar. 17, 2009

(65) Prior Publication Data

US 2010/0238227 A1 Sep. 23, 2010

(51) Int. Cl.
*B41J 29/393* (2006.01)
*B41J 2/165* (2006.01)

(52) U.S. Cl. ..... 347/19; 347/22

(58) Field of Classification Search ..... 347/17, 347/19, 22, 30, 35, 36
See application file for complete search history.

(56) References Cited

U.S. PATENT DOCUMENTS

| | | | | |
|---|---|---|---|---|
| 4,240,082 | A * | 12/1980 | Yu | 347/22 |
| 4,329,696 | A | 5/1982 | Denlinger et al. | |
| 4,774,526 | A * | 9/1988 | Ito | 347/171 |
| 4,862,287 | A * | 8/1989 | Paul | 358/296 |
| 5,455,615 | A * | 10/1995 | Burr et al. | 347/92 |
| 5,831,643 | A * | 11/1998 | Chung | 347/17 |
| 5,980,034 | A * | 11/1999 | Tsai et al. | 347/89 |
| 7,690,776 | B2 * | 4/2010 | DeVore et al. | 347/92 |
| 7,717,540 | B1 * | 5/2010 | King et al. | 347/34 |

* cited by examiner

*Primary Examiner* — Anh T. N. Vo
(74) *Attorney, Agent, or Firm* — MH2 Technology Law Group LLP

(57) ABSTRACT

A system and method to provide pressure to de-prime a printhead. An image forming device comprises an ink reservoir that contains ink and provides the ink to a printhead. When a fault condition is detected that indicates a likelihood of a solidifying of the ink, the printhead is de-primed by applying pressure to the printhead to purge the ink from the printhead. The fault condition comprises any of a loss of power, a power-down process, or a printhead temperature being less than or equal to a threshold temperature.

20 Claims, 3 Drawing Sheets

PRINTHEAD DE-PRIME SYSTEM AND METHOD FOR SOLID INK SYSTEMS

FIELD OF THE INVENTION

The present invention generally relates to de-priming a printhead in an image forming device.

BACKGROUND OF THE INVENTION

Conventional solid ink printers, such as a microelectromechanical system jet (MEMSJet) printer, create an image on an image substrate by melting ink and delivering the melted ink to a printhead reservoir, where it is then transferred onto the substrate through a face plate in the printhead. When the solid ink printer is turned off or otherwise loses power, the ink that remains in the printhead reservoir can solidify and decrease in volume by about 15-20%. If the flexible, drop-ejecting membranes located in the printhead are in intimate contact with the ink as the ink solidifies, then the membranes can be deformed to the point of breaking as a result of the ink volume decrease. Further, when the ink in the printhead solidifies, additional ink from the ink supply system can be drawn into the printhead due to the volume reduction of the solidified ink. Upon thawing, the volume increase of the ink in the printhead can add pressure to the printhead, leading to added pressure to the membranes.

After the printer undergoes a solidify/thaw cycle, the performance of MEMSJet printheads can degrade due to broken membranes. Further, once broken, the membranes can no longer be used to eject ink drops, and ink can then get under the membranes and into the rest of the vent system, which can severely damage or destroy the printhead. The thawing process can also cause enough pressure buildup to delaminate the nozzle plate from the actuator walls, thereby damaging or destroying the printhead.

Known methods of preventing this damage include de-priming the printhead, or removing the ink from the printhead before it is allowed to solidify. Known de-priming processes can be performed during a normal printer shutdown or during a power fault. The known de-priming processes can cause the ink to be pulled from the printhead and back into an ink reservoir from which the ink is normally stored. However, this process can result various problems, such as, for example, contaminants being drawn into the nozzles, printhead, and ink reservoir. Thus, there is a need to overcome this and other problems of the prior art.

SUMMARY OF THE INVENTION

In accordance with the present teachings, a method of de-priming a printhead in an image forming device is provided. The exemplary method can include providing ink in the printhead. A plurality of fault conditions that are based on a likelihood of a solidifying of the ink can be detected. A pressure can be configured to purge the ink from the printhead. A valve can be opened to input the pressure into the printhead In accordance with the present teachings, another method of de-priming a printhead in an image forming device is provided. The exemplary method can include receiving ink into the printhead. One of a plurality of fault conditions that is based on a likelihood of a solidifying of the ink can be detected by a control element. A pressure can be inputted into the printhead to purge the ink from the printhead.

In accordance with the present teachings, a system for de-priming a printhead is provided. The exemplary system can include a printhead configured to receive ink from an ink reservoir The exemplary system can further include a control element configured to detect one of a plurality of fault conditions that are based on a likelihood of a solidifying of the ink and open a pressure valve. The exemplary system can still further include a pressure source configured to provide pressure to the printhead through the pressure valve to purge the ink from the printhead.

DESCRIPTION OF THE EMBODIMENTS

Figure 1:
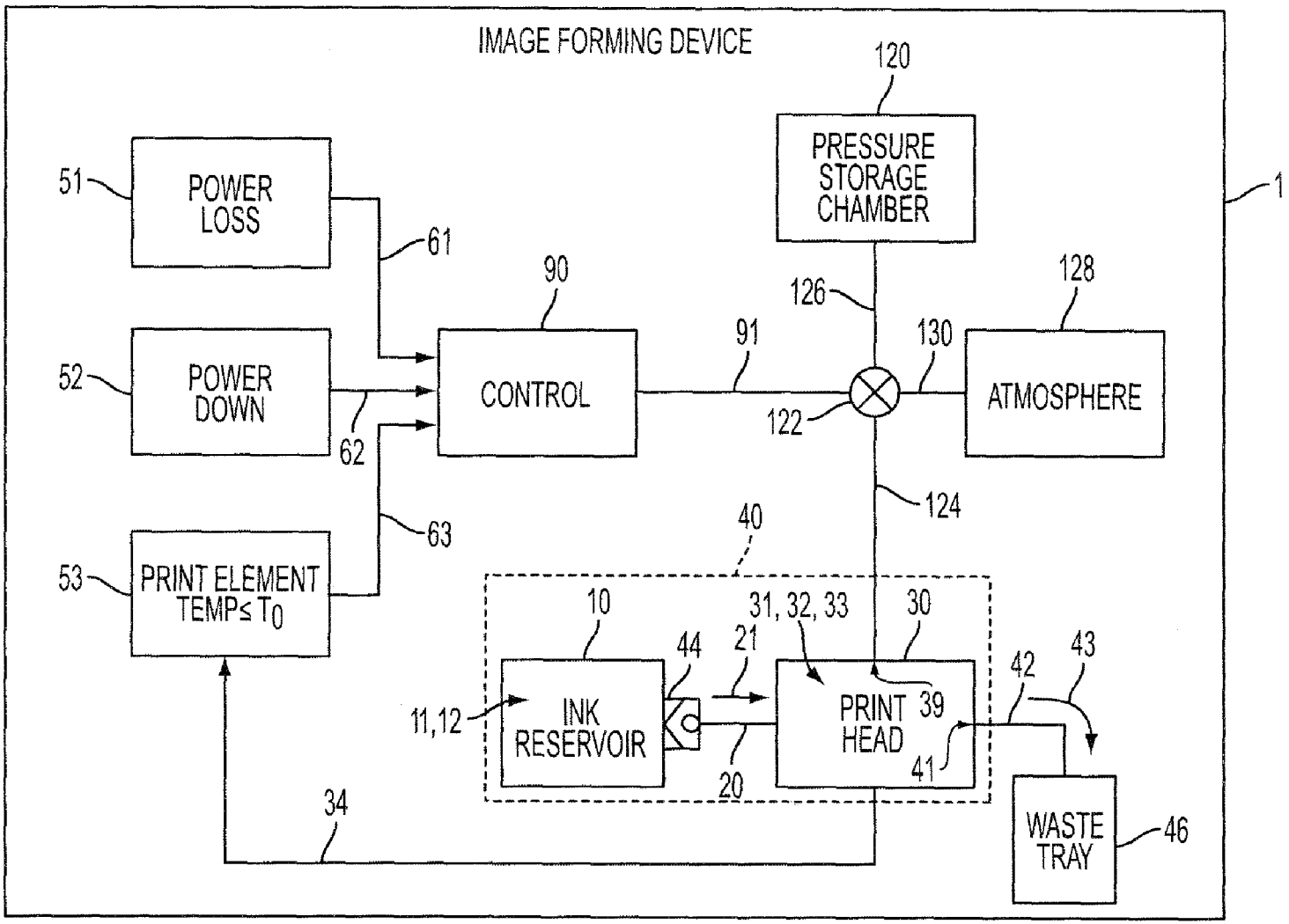
FIG. 1 depicts a schematic of an exemplary image forming device implementing the de-prime system and method.

Reference will now be made in detail to the exemplary embodiments of the invention, examples of which are illustrated in the accompanying drawings. Wherever possible, the same reference numbers will be used throughout the drawings to refer to the same or like parts. It should be appreciated that the exemplary system and method depicted in FIGS. 1-3 can be employed in any solid ink imaging device.

When ink from a solid ink imaging device solidifies and enters a solid state, the ink can undergo a significant volume decrease relative to its liquid form, usually in the 15-20% range. The shrinkage can be problematic when the ink solidifies in the printhead of the printer, as the decrease can be an order of magnitude larger than the distance a printhead membrane normally moves during normal printer operation. A deflection of this order can cause the printhead membrane to break or crack, assuming an adhesion exists between the membrane and the ink.

In addition to the damaging effects hypothesized by the solidifying process, damage can also be induced during the ink thawing process. For example, if a printhead actuator is full of ink, and the ink subsequently solidifies, then liquid ink can be drawn in from the ink supply system to compensate for the volume reduction caused by the solidifying ink. Along the way, the ink can solidify in the ink supply system.

Upon the reheating of the printhead and ink supply system, if the printhead ink melts before the ink supply system ink does, then the printhead ink can be blocked from flowing back into the system by the solid ink in the printhead ink supply system. The only remaining yield, then, is the printhead membrane, which can eventually crack with enough pressure/volume change from the thawing ink.

When the printhead of an image forming device is de-primed before the ink is allowed to solidify, then the probability of any membranes breaking during the solidify or thaw cycles is lower. The de-prime process can relieve pressure from the membranes because the volume of ink left in the actuator can be reduced. Further, air can be introduced into the actuator chamber, thereby functioning to absorb the volume change. The de-priming process can occur during a normal printer shutdown as well as during a power fault, such as, for example, when there is no wall outlet power available to the printer.

A positive pressure de-prime system and method is hereby described. Instead of known de-prime systems that draw printhead ink back into an ink reservoir via a vacuum, the present system and method can apply positive pressure to the printhead to purge the ink from the printhead and into a waste tray. Benefits of a positive pressure de-prime system and method can include minimizing drawing contaminants into the nozzles, printhead, and ink reservoir, minimizing entraining air into the ink and ink supply, cooling the printhead by air flow and gas expansion, implementing the system and method with minimal complexity, reusing of components, and not requiring extra power or batteries.

Positive pressure can be applied to the printhead upon the detection of a fault condition. In particular, upon a detection, a valve can open and allow pressure to be transmitted to the printhead, while simultaneously close and block the printhead's path to the atmosphere. The application of the pressure is similar to known purge operations, but instead the volume and duration of the positive pressure is much greater, thereby resulting in a sufficient or complete purging of ink from the printhead. In a zero power condition, the pressure can be applied from a pressure storage chamber, or by using an auxiliary power source such as a battery to energize a pump and any needed control mechanisms.

Embodiments of the system and method can utilize existing hardware or components of an existing ink delivery system. The system and method can include a pressure storage chamber or tank, and a check valve connected to the existing hardware. The pressure can be maintained within this vessel during normal, powered operation by using, for example, a pump, which can be an existing pump in the system.

The check valve can be attached to a printhead nozzle via a vent line and can isolate the pressure from the printhead by keeping the valve closed to the pressure and open to the atmosphere while the printhead is continuously energized. Ink delivery to the printhead can be controlled and monitored by an ink-level sensing process, and the ink delivery can be performed when the printhead vent line is open to the atmosphere, thereby preventing inadvertent purging. There can be ball check valves in the system that are internal to the system and that can prevent back flow of ink into the ink reservoir.

The following text describes various embodiments of the present system and method. The concepts are described within the context of a solid ink delivery system utilizing an ink melter and an umbilical to deliver ink to a printhead, as is conventionally known in the art. In embodiments, the system and method can be similarly implemented in other print systems.

Referring to FIG. 1, depicted is a schematic of an exemplary image forming device 1 implementing the de-prime system and method. In accordance with embodiments of the present system and method, the image forming device 1 can include a print element 40 The print element 40 can include an ink reservoir 10 that can contain reservoir ink 11, and a printhead 30. The ink reservoir 10 can provide the reservoir ink 11 to the printhead 30 via an ink supply channel 20, thus forming a printhead ink 31 in the printhead 30. The printhead ink 31 can be stored in the printhead 30 during operation of the image forming device 1. A ball check valve 44 can be positioned along the ink supply channel 20 and near the ink reservoir 10 to prevent any back flow of printhead ink 31 into the ink reservoir 10. In embodiments, the printhead 30 can include a maintenance cap (not shown in figures) to handle any fluctuations in pressure.

When a fault condition is detected that indicates a likelihood of a solidifying of the printhead ink 31, the printhead 30 is de-primed by forcing the printhead ink 31 to purge, evacuate, discharge, withdraw or flow from the printhead 30 to a waste tray 46 via an exit nozzle 41 and a drip bib 42. For example, in embodiments, the drip bib 42 can collect the purged ink from the exit nozzle 41 and form the purged ink into drops that can fall off the bottom of the drip bib 42 and into the waste tray 46. The fault conditions can comprise any of a loss of power, a power-down process, or a printhead temperature 33 being less than or equal to a threshold temperature ($T_o$).

In embodiments, the ink reservoir 10 can include a reservoir pressure 12 that can be a measurement equal to the pressure of the reservoir ink 11 in the ink reservoir 10. Similarly, the printhead 30 can include a printhead pressure 32 that can be a measurement equal to the pressure of the printhead ink 31 in the printhead 30. The printhead 30 can further include the printhead temperature 33 that can be a measurement equal to the temperature within the printhead 30.

In accordance with an embodiment of a system and method to de-prime the printhead 30, a power loss detector 51, a power down detector 52, and a printhead temperature detector 53 can be arranged to detect at least one of a plurality of fault conditions that can be an indicator of a likelihood of a solidifying of the printhead ink 31.

The power loss detector 51 can be configured to detect a first fault condition comprising a loss of power such as, for example, if the image forming device 1 is unplugged. Upon detecting a loss of power, the power loss detector 51 can signal a control 90 via a corresponding power loss detector output 61.

The power down detector 52 can be configured to detect a second fault condition comprising a power-down process such as, for example, if the image forming device 1 is shut down. Upon detecting a power-down process, the power down detector 52 can signal the control 90 via a corresponding power down detector output 62.

The printhead temperature detector 53 can be configured to detect a third fault condition comprising the printhead temperature 33 being less than or equal to the threshold temperature ($T_0$). Referring to FIG. 1, the printhead temperature 33 can be provided to the printhead temperature detector 53 via a printhead temperature signal 34. Upon detecting that the printhead temperature 33 is less than or equal to the threshold temperature, the printhead temperature detector 53 can signal the control 90 via a corresponding printhead temperature detector output 63.

When at least one fault condition is detected by any of the detectors 51, 52, 53, the respective detector outputs 61, 62, 63 can signal the control 90. The control 90 can, in turn, signal to cause the printhead ink 31 to purge, evacuate, discharge, withdraw or flow from the printhead 30 to the waste tray 46 via the drip bib 42, generally as depicted in FIG. 1 by reference number 43. In embodiments, the printhead ink 31 can be purged without the implementation of the waste tray 46.

In embodiments, in accordance with the present system and method, an increase in the printhead pressure 32 can cause the printhead ink 31 to purge, evacuate, discharge, withdraw or flow from the printhead 30. As shown in FIG. 1, the control 90 can be configured to activate a pressure valve 122 via a control pressure valve output 91. A pressure storage chamber 120 can be coupled to the pressure valve 122 via a pressure storage channel 126, and the pressure valve 122 can be coupled to the printhead 30 at a printhead nozzle 39 via a printhead channel 124.

In embodiments, the pressure storage chamber 120 comprises a positive pressure source that is maintained by using an atmosphere blower, a compressor pump, or a ball-check valve (not shown in figures). By activating the pressure valve 122, positive pressure from the pressure storage chamber 120 can be applied to the printhead 30, thereby causing the printhead ink 31 to purge, evacuate, discharge, withdraw or flow from the printhead 30 to the waste tray 46 via the exit nozzle 41 and the drip bib 42, generally as depicted by reference number 43. In embodiments, during normal, powered operation of the image forming device 1, the pressure valve 122 can be coupled to atmosphere 128 by an atmosphere channel 130.

Figure 2:
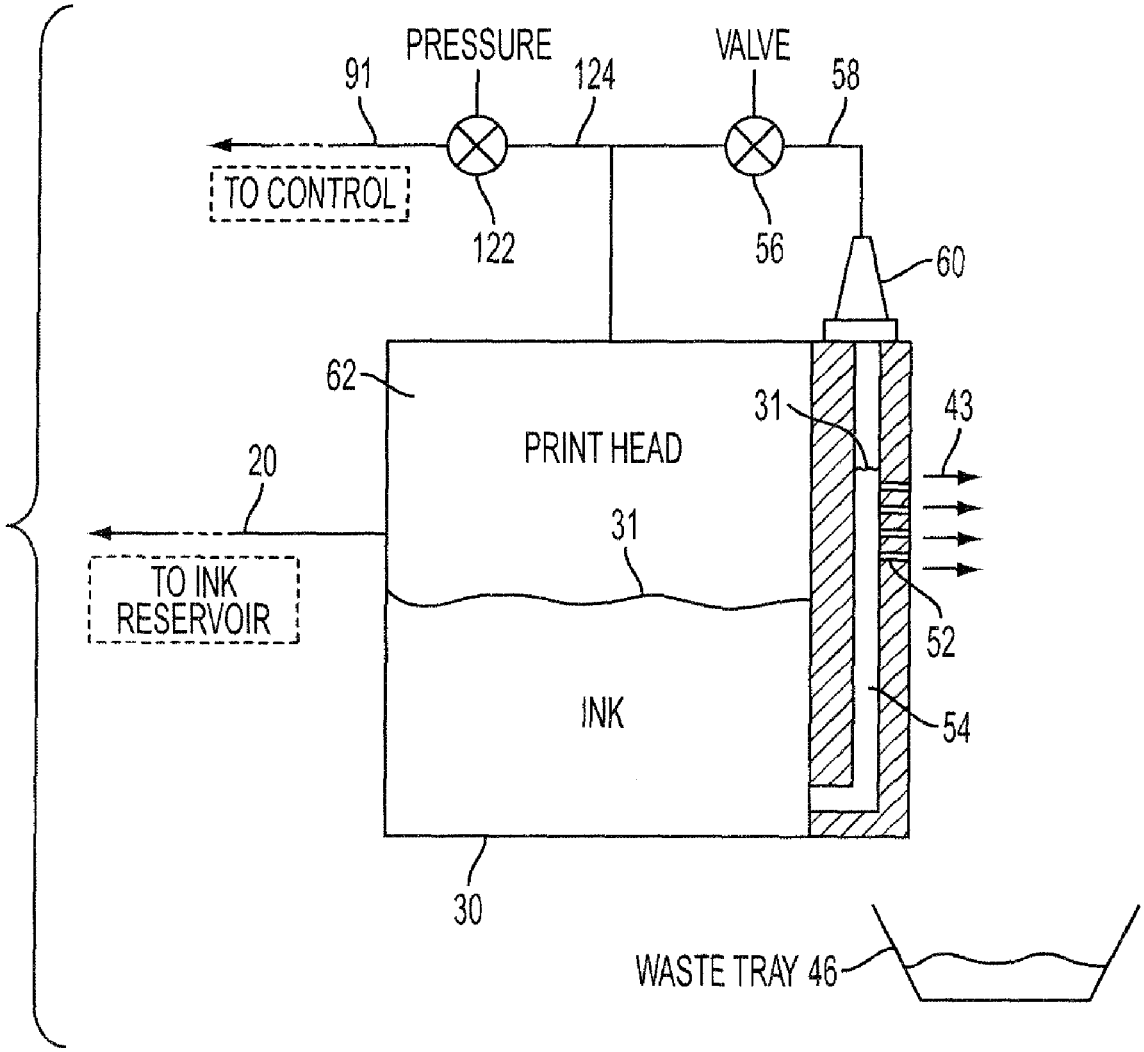
FIG. 2 depicts a schematic of a section of an exemplary image forming device implementing the de-prime system and method.

Referring to FIG. 2, a schematic of a section of an exemplary image forming device implementing the de-prime system and method is depicted. As shown, the printhead 30 can include a siphon channel 54, the printhead ink 31, an ink cavity 62, and a plurality of ink vents 52. The printhead ink 31 can enter the ink cavity 62 from the ink reservoir 10 through the ink supply channel 20. During printing, printhead ink 31 can enter the siphon channel 54 and exit the plurality of ink vents 52 to an image substrate. If the level of printhead ink 31 in the ink cavity 62 falls below the level of the plurality of ink vents 52, the siphon channel 54 can siphon printhead ink 31 into the siphon channel 52 to a level at least equal to the plurality of ink vents 52. Accordingly, printhead ink 31 can still exit the printhead 30 if the printhead ink 31 in the ink cavity 62 falls to a level lower than the level of the plurality of ink vents 52.

The printhead 30 can further include a nipple 60 that can be connected to the printhead 30 and to a siphon valve 56 via an alternate channel 58. The siphon valve 56 can be connected to the pressure valve 122 via an extension to the printhead channel 124. The siphon valve 56 can be opened to relay the pressure in the printhead channel 124 to enter the alternate channel 58. For example, if the pressure valve 122 is opened to the pressure from the pressure storage chamber 120, and the siphon valve 56 is open, then the nipple 60 can receive the pressure from the storage chamber 120.

Upon any of the fault conditions necessitating a de-prime as described herein, the siphon valve 56 can open and the siphon channel 54 can receive the positive pressure from the pressure storage chamber 120 or equivalents. As a result, the printhead ink 31 can be purged 43 from the siphon channel 54 via the plurality of ink vents 52. The purged ink can enter the waste tray 46. For example, if the image forming device 1 experiences a power loss, the siphon channel 54 can receive a positive pressure from the pressure storage chamber 120 via the siphon valve 56. A sufficient amount of pressure can be applied to the siphon channel 54 so that the printhead ink 31 is purged through the plurality of ink vents 52 and so that the printhead ink 31 recedes to a level below the plurality of ink vents 52. The amount of stored pressure required to purge the siphon channel 54 can be less than the amount of stored pressure required to purge the ink cavity 62. In embodiments, the amount of pressure can vary based on the size of the components of the printhead 30, the amount of ink in the printhead 30, the size of the pressure storage chamber 120, and other factors.

Figure 3:
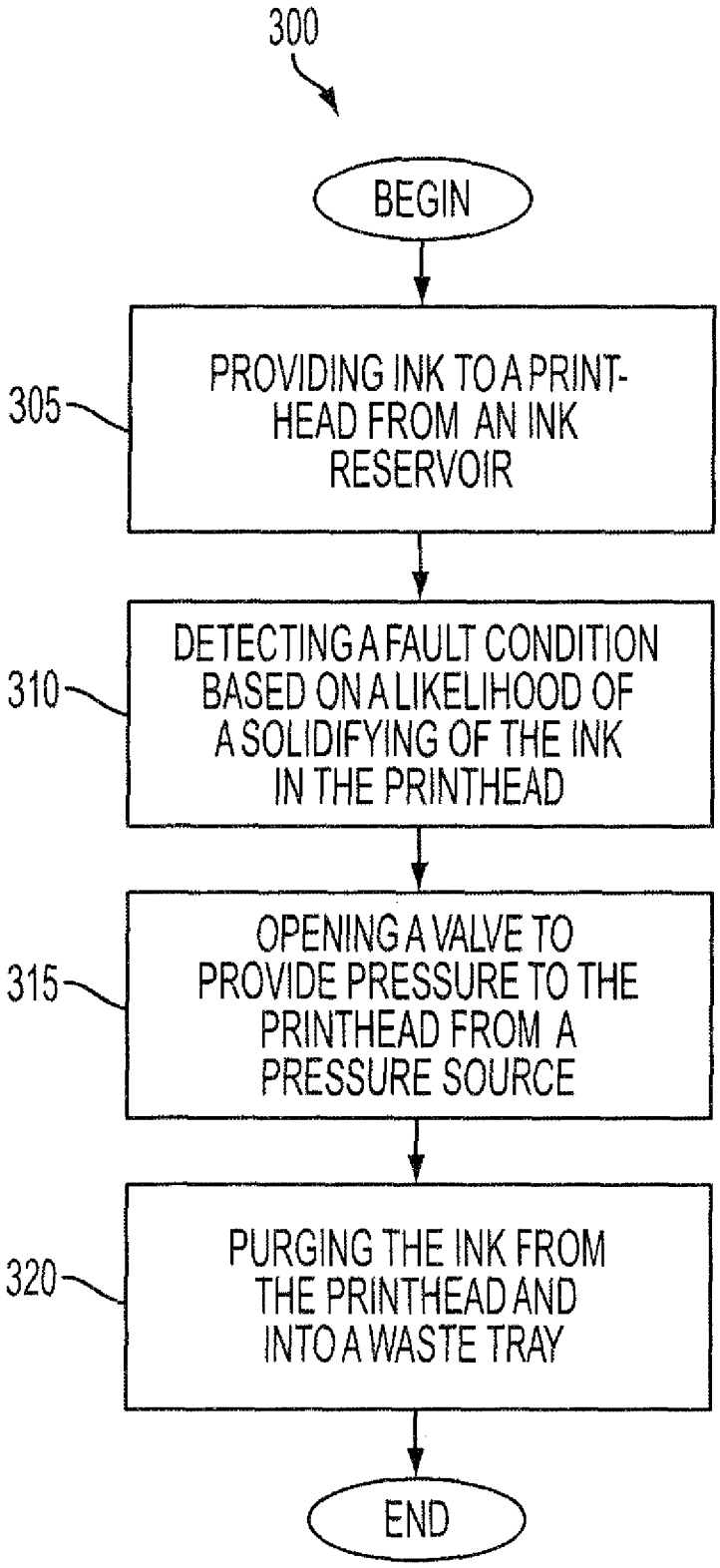
FIG. 3 depicts a flow diagram of an exemplary method of de-priming a printhead.

Referring to FIG. 3, a flow diagram of an exemplary method 300 of de-priming a printhead is depicted. In 305, ink from an ink reservoir can be provided to a printhead. For example, ink can be provided to the printhead via an ink supply channel. In 310, a control element can detect a fault condition based on a likelihood of a solidifying of the ink in the printhead. The fault condition can be one of a power loss, a power down, or a printhead temperature being less than or equal to a threshold temperature. In 315, a valve can be opened to provide pressure to the printhead from a pressure source. In embodiments, the pressure source can be, for example, a pressure storage chamber. In 320, the pressure can purge the ink from the printhead and into a waste tray. It should be appreciated that the ink can be purged to any location or reservoir exterior to the printhead. In embodiments, a ball check valve can prevent the ink from re-entering the ink reservoir.

While the invention has been illustrated with respect to one or more exemplary embodiments, alterations and/or modifications can be made to the illustrated examples without departing from the spirit and scope of the appended claims. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items, such as, for example, "one or more of A and B," means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of de-priming a printhead in an image forming device, the method comprising:
   providing a liquid ink to the printhead;
   detecting, prior to solidification of the liquid ink within the printhead, one of a plurality of fault conditions, wherein the detected fault condition is based on a likelihood of solidification of the liquid ink within the printhead; and
   in response to detecting the one of the plurality of fault conditions, opening a valve configured to input pressure into the printhead to de-prime the printhead, wherein inputting the pressure causes the liquid ink to be purged from the printhead prior to solidification of the liquid ink.

2. The method of claim 1, wherein the liquid ink is provided from an ink reservoir via an ink supply channel.

3. The method of claim 1, wherein the liquid ink is purged from a siphon channel in the printhead.

4. The method of claim 1, wherein the pressure is inputted from a pressure storage chamber.

5. The method of claim 1, wherein the printhead is connected to atmosphere prior to the opening of the valve.

6. The method of claim 1, wherein the liquid ink is purged from the printhead and into a waste tray via a drip bib.

7. The method of claim 1, wherein detecting the one of the plurality of fault conditions comprises detecting one of a power loss, a power down, or a printhead temperature being less than or equal to a threshold temperature.

8. A method of de-priming a printhead in an image forming device, the method comprising:
   receiving liquid ink into the printhead;
   detecting, by a control element prior to solidification of the liquid ink within the printhead, a fault condition, wherein the detected fault condition is based on a likelihood of solidification of the liquid ink within the printhead; and
   in response to detecting the fault condition, inputting pressure into the printhead via a valve to de-prime the printhead, wherein inputting the pressure causes the liquid ink to be purged from the printhead prior to solidification of the liquid ink.

9. The method of claim 8, wherein the liquid ink is received from an ink reservoir via an ink supply channel.

10. The method of claim 8, wherein the liquid ink is purged from a siphon channel in the printhead.

11. The method of claim 8, wherein inputting the pressure into the printhead comprises opening the valve.

12. The method of claim 11, wherein the printhead is connected to atmosphere prior to the opening of the valve.

13. The method of claim 8, wherein the pressure is inputted from a pressure storage chamber.

14. The method of claim 8, wherein the liquid ink is purged from the printhead and into a waste tray via a drip bib.

15. The method of claim 8, wherein the fault condition is one of a power loss, a power down, or a printhead temperature being less than or equal to a threshold temperature.

16. A system for de-priming a printhead comprising:

a printhead configured to receive liquid ink from an ink reservoir;

a control element configured to:

detect, prior to solidification of the liquid ink within the printhead, a fault condition that is based on a likelihood of solidification of the liquid ink within the printhead, and in response to detecting the fault condition, open a pressure valve; and a pressure source configured to provide pressure to the printhead via the pressure valve to de-prime the printhead, wherein providing the pressure causes the liquid ink to be purged from the printhead prior to solidification of the liquid ink.

17. The system of claim 16, wherein the liquid ink is purged from the printhead via a siphon channel.

18. The system of claim 16, wherein the pressure source is a pressure storage chamber.

19. The system of claim 16, wherein the printhead is connected to atmosphere prior to the opening of the pressure valve.

20. The system of claim 16, wherein the fault condition is one of a power loss, a power down, or a printhead temperature being less than or equal to a threshold temperature.

* * * * *